United States Patent [19]

Holan

[11] 3,981,468

[45] Sept. 21, 1976

[54] STAND

[76] Inventor: Leif A. Holan, Chimney Rock, Winona, Minn. 55987

[22] Filed: May 12, 1975

[21] Appl. No.: 576,353

[52] U.S. Cl. ..... 248/167; 248/172; 248/188.6

[51] Int. Cl.[2] ..... F16M 11/38

[58] Field of Search ..... 108/117, 120, 78, 79; 248/167, 172, 173, 188.6, 296, 298, 188.7; 403/91

[56] References Cited

UNITED STATES PATENTS

| | | | |
|---|---|---|---|
| 897,520 | 9/1908 | Brenner | 108/79 |
| 1,039,868 | 10/1912 | Whitney | 403/91 X |
| 1,240,648 | 9/1917 | Banks | 248/173 |
| 1,609,242 | 11/1926 | Dewey | 248/167 |
| 1,890,729 | 12/1932 | Ganson | 248/167 |
| 2,158,546 | 5/1939 | Lang et al. | 248/167 |
| 3,000,679 | 9/1961 | Silverman | 248/167 |
| 3,526,380 | 9/1970 | Tong | 248/188.6 X |

FOREIGN PATENTS OR APPLICATIONS

| | | | |
|---|---|---|---|
| 288,282 | 1928 | United Kingdom | 248/188.6 |

*Primary Examiner*—Lawrence J. Staab
*Attorney, Agent, or Firm*—R. J. Renk

[57] ABSTRACT

A stand including a body member and a leg member which may be pivotally moved about an axis and wherein the axis itself may be moved relative to the body member.

3 Claims, 3 Drawing Figures

STAND

BACKGROUND OF INVENTION

The present invention relates to a stand arrangement which may be used for supporting objects of different shapes and sizes. In particular, it has particular utility in the furniture field.

Because of the many and varied shapes, it has been difficult to provide suitable mountings for many furniture items such as radio and phonograph speakers, tables, television sets, lamps, etc. without providing a separate stand arrangement for each model or shape.

SUMMARY OF INVENTION

The present invention provides a stand which may be modified in its length and width as well as in other configurations to provide support for odd-shaped items and thereby provide a structure which has vast versatility in its supporting configurations.

PREFERRED EMBODIMENTS

Figure 1:
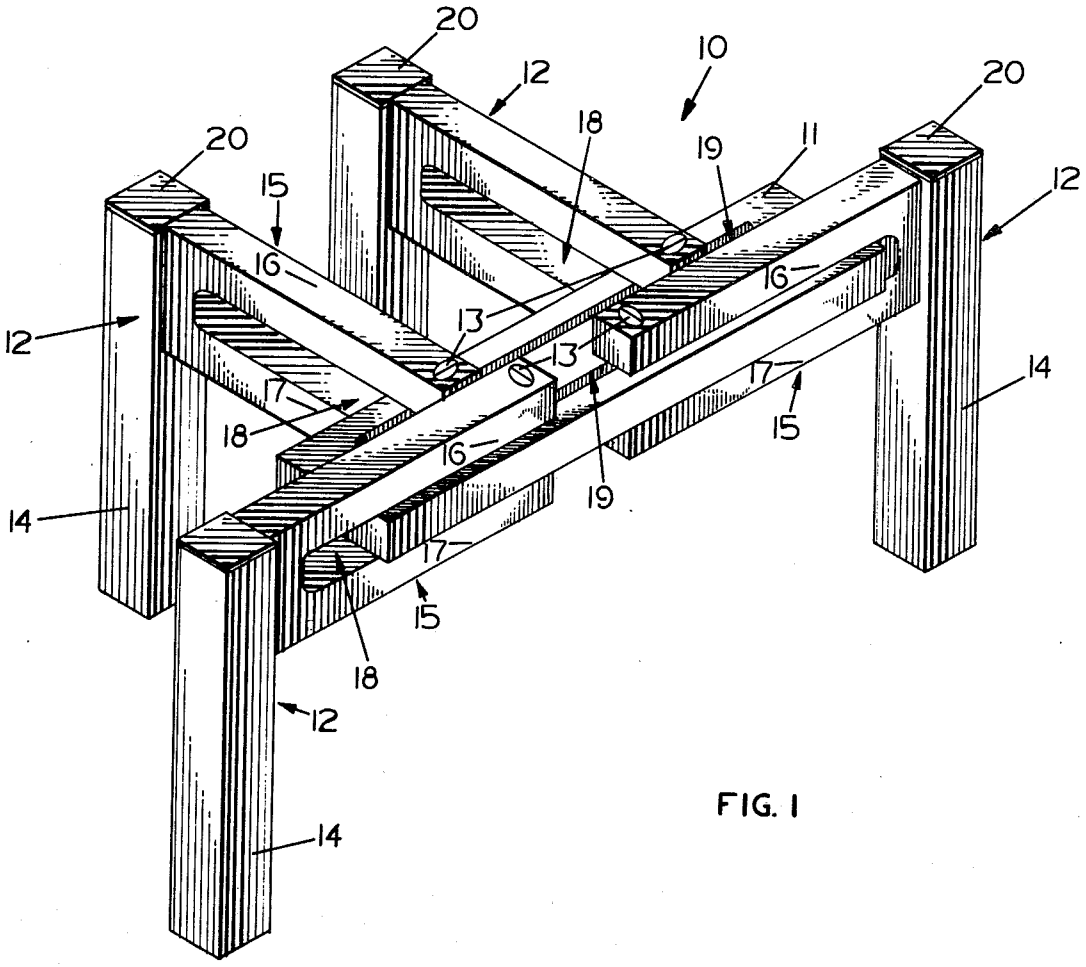
FIG. 1 is a perspective view of one embodiment of the stand of the invention.

In the drawings, the numeral 10 generally denotes the stand of the invention. The stand includes a body member 11 and a number of leg members 12.

The position of the legs can be changed relative to the body by rotating the legs relative to the body about a vertical axis 13, or by movement of a particular axis 13 along a generally horizontal plane relative to the body.

Figure 3:
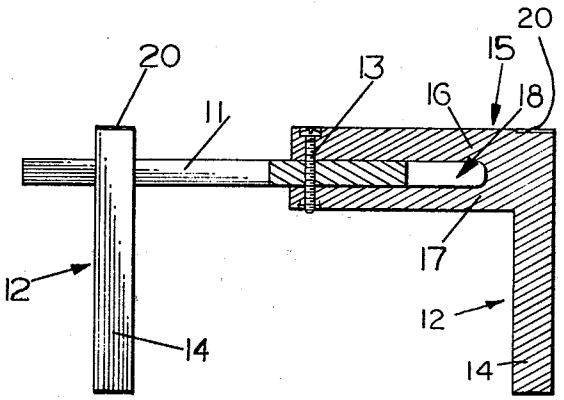
FIG. 3 is a vertical side view of the stand in FIG. 2 showing a partial sectional view of a leg member taken along lines 3—3 of FIG. 2.

As shown in FIGS. 1 and 3, the legs 12 are shown to be in the shape of the letter F and include an upstanding portion or post 14 and a forked horizontal portion 15 extending at substantially right angles to the post. The forked section includes a top finger 16 and a bottom finger 17 which between them define an opening 18.

The legs 12 are moveably secured to the body 11 by a suitable pin (to form the axis 13) such as a screw or dowel which extends through the fingers 16 and 17 and through an elongated slot 19 in the body member. The legs 12 are secured to the body 11 with the fingers 16 and 17 straddling the body 11 (the body in effect extends into the opening 18 between the fingers). Clearance is provided in the slot 19 to allow the pin 13 to be slid laterally with respect to the body 11 to thereby change the location of the vertically disposed pivotal axis and position of the legs 12.

Figure 2:
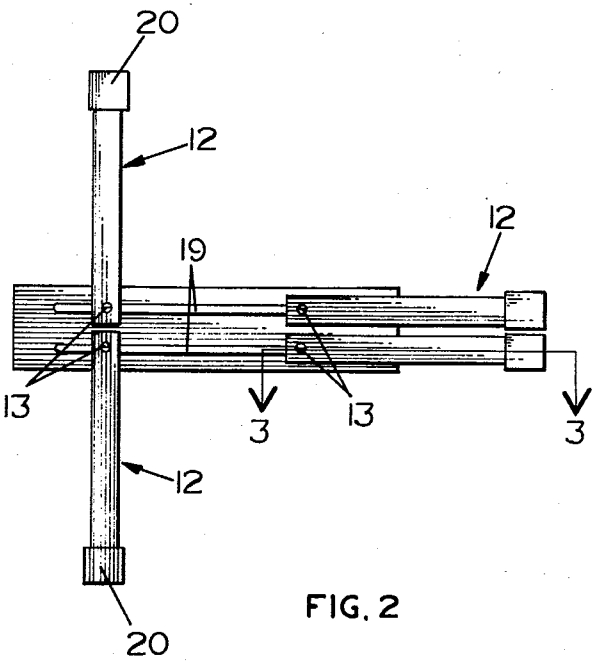
FIG. 2 is a top view of a stand showing the leg members thereof in different positions in FIG. 1.

It will thus be apparent that the legs 12 may be pivoted to positions which are not at right angles to the body 11, or in other words, skewed with respect to the body. The legs may also be adjusted laterally with respect to the body. The combination of positions thereby provides an unlimited variety of supporting configurations to accomodate objects of different shapes. (For example two different positions are shown in FIGS. 1 and 2.) Once the legs are located in the desired position they can be locked by tightening of the pins.

To keep an object mounted on the stand from sliding, the tops 20 of the posts 14 may have a pad of resilient or other material adhered thereto.

In the embodiment shown, the body 11 is provided with two longitudinal slots 19; two legs 12 are connected to each slot. However, any number of legs and slots may be used, and the slots of course can take on other shapes other than linear or enclosed shapes. The slots likewise do not have to extend through the body 11 but can be in the form of a T-slot or the like. In this connection, it is also possible for the fingers 16 and 17 to be slotted to provide even greater adjustment of the legs relative to the body. Additional flexibility may also be provided by making the body of different configurations such as round, oblong, triangular, etc.

What I claim is:

1. A stand comprising, a centrally disposed body member, a plurality of leg members, at least one of said leg members having an upright portion one end of which is adapted to engage a base surface and having spaced apart fingers extending at substantially right angles to the upright portion, said spaced apart fingers defining an unobstructed opening therebetween and straddling said body member with a finger on opposed sides of said body member, means connecting a leg member having the spaced apart fingers to said body member, said means allowing said leg member to be adjusted pivotally about an axis and also allowing said axis to be moved to different positions with respect to said body member while retaining the upright portion of said leg member in an upright position, said axis being parallel to said upright portion of said leg and means for locking said axis and its associated leg at various positions relative to the body member.

2. A stand as claimed in claim 1 wherein said upright portions have areas which extend above the level of the spaced apart fingers to act as supporting pads, and wherein said fingers are located intermediate the height of said upright portions.

3. A stand as claimed in claim 1 wherein said means connecting a leg member includes an elongated slot in said body member.

* * * * *